US007138754B2

(12) United States Patent
Han et al.

(10) Patent No.: US 7,138,754 B2
(45) Date of Patent: Nov. 21, 2006

(54) CATHODE FOR ELECTRON TUBE AND METHOD FOR MANUFACTURING THE SAME

(75) Inventors: Seung-Kwon Han, Seoul (KR); Jong-Seo Choi, Anyang (KR); Dong-Hee Han, Suwon (KR); Sung-Hwan Moon, Suwon (KR)

(73) Assignee: Samsung SDI Co., Ltd., Suwon-si (KR)

( * ) Notice: Subject to any disclaimer, the term of this patent is extended or adjusted under 35 U.S.C. 154(b) by 12 days.

(21) Appl. No.: 10/246,396

(22) Filed: Sep. 19, 2002

(65) Prior Publication Data

US 2003/0178927 A1 Sep. 25, 2003

(30) Foreign Application Priority Data

Mar. 21, 2002 (KR) ..... 2002-15383

(51) Int. Cl.
*H01J 1/142* (2006.01)
*H01J 19/062* (2006.01)
*H01J 1/20* (2006.01)

(52) U.S. Cl. ..... 313/346 R; 313/337

(58) Field of Classification Search ..... 313/346 R, 313/355, 337, 346 DC, 452, 310, 311; 445/50–51
See application file for complete search history.

(56) References Cited

U.S. PATENT DOCUMENTS 5,757,115 A 5/1998 Narita et al. ..... 313/346 R
6,351,061 B1 * 2/2002 Yamauchi et al. ..... 313/346 R
2002/0163308 A1 * 11/2002 Gaertner et al. ..... 315/3

FOREIGN PATENT DOCUMENTS

| | | |
|---|---|---|
| EP | 0 421 372 A2 * | 4/1991 |
| EP | 0560436 A1 | 9/1993 |
| JP | 53-91562 * | 11/1978 |
| JP | 6-28968 | 2/1994 |
| JP | 2001-229814 | 8/2001 |
| KR | 1999-53587 | 7/1999 |

OTHER PUBLICATIONS

"Progress on the Percolation Cathode" by S.N.B. Hodgson et al. (IDW '99 Proceedings of the Sixth International Display Workshops CRT 6-4 (Late-News Paper)).
*Notice to Submit Response*, issued by the Korean Industrial Property Office on Jan. 30, 2004.

* cited by examiner

*Primary Examiner*—Karabi Guharay
(74) *Attorney, Agent, or Firm*—Robert E. Bushnell, Esq.

(57) ABSTRACT

An oxide cathode for an electron tube and a method for manufacturing the oxide cathode are provided. In the oxide cathode including a sleeve for a heater, a metal substrate formed on the top of the sleeve, and an electron emission material layer coated on the metal substrate, the electron emission material layer is formed by coating a carbonate paste containing an alkaline earth metal carbonate, an organic blowing agent, and a vehicle on the metal substrate by screen printing, and thermally treating the coated carbonate paste. Picture quality degradation due to a Moire phenomenon is reduced by coating the carbonate paste by screen printing to provide an even cathode surface, and degradation of the cathode by Joule heat is reduced, thereby improving electron emission and lifespan characteristics of the cathode.

7 Claims, 7 Drawing Sheets

CATHODE FOR ELECTRON TUBE AND METHOD FOR MANUFACTURING THE SAME

CLAIM OF PRIORITY

This application makes reference to, incorporates the same herein, and claims all benefits accruing under 35 U.S.C. § 119 from an application for CATHODE FOR ELECTRON TUBE AND PREPARING METHOD THEREFOR earlier filed in the Korean Industrial Property Office on 21 Mar. 2002 and there duly assigned Serial No. 2002-15383.

BACKGROUND OF THE INVENTION

1. Field of the Invention

The present invention relates to a cathode for an electron tube and a method for manufacturing the same, and more particularly, to reduction of a Moire phenomenon and improvement of the lifespan characteristics of oxide-coated thermoelectron emission electrodes (oxide electrodes) widely used in general Braun tubes.

2. Description of the Related Art

A conventional cathode for an electron tube is illustrated by a sectional view in FIG. 1. As shown in FIG. 1, the cathode includes a disc-type metal substrate 12, a cylindrical sleeve 13 which supports the metal substrate 12 below the same and installs a heater 14 acting as a heater of the cathode, and an electron emissive material layer 11 attached to the top of the metal substrate 12. Such an oxide cathode for the electron tube can work at a low temperature of 700–800° C. (Celsius) due to its low work function and has been widely used in Braun tubes.

A conventional oxide cathode is manufactured by forming the electron emissive material layer 11 on the metal substrate 12, which contains nickel (Ni) as a major component and traces of silicon (Si), magnesium (Mg), tungsten (W), etc., as a reducing agent. The electron emissive material layer 11 is formed by spraying a suspension of carbonate on the metal substrate 12. The carbonate suspension is prepared by dissolving a binder such as nitrocellulose in an organic solvent and mixing the solution with an alkaline earth metal carbonate containing barium as a major component, preferably, a ternary carbonate of $(Ba,Sr,Ca)CO_3$ or a binary carbonate of $(Ba,Sr)CO_3$. The carbonate is converted into oxide during the evacuation or activation process in the manufacture of the cathode to act as the electron emissive material layer 11.

The principles of operation and electron emission of the oxide cathode are as follows.

A carbonate mixture is coated on a metal substrate by spraying or deposition, as described above, the resulting cathode is mounted into an electron gun to assemble an electron tube. During evacuation of the electron tube, the carbonate is heated by a heater to about 1000° C., and barium carbonate is converted into barium oxide:

$$BaCO_3 \rightarrow BaO + CO_2\uparrow \quad (1)$$

During the operation of the cathode, the resulting barium oxide is reduced through a reaction with a reducing agent such as Si or Mg at the boundary of the metal substrate and produces free barium that triggers electron emission:

$$BaO + Mg \rightarrow MgO + Ba \quad (2)$$

$$BaO + Si \rightarrow Ba_2SiO_4 + 2Ba \quad (3)$$

Free barium acts as an electron donor, so the oxide cathode becomes an n-type semiconductor during the cathode operation. In general, when a large quantity of current flows through a semiconductor, the semiconductor generates Joule heat by its own resistance. If the generation of the Joule heat continues for a long time, material evaporation or melting occurs due to the heating of the cathode, which causes degradation of the cathode. In other words, when existing oxide cathodes are used under a high current density applied to enhance the electron emission density of the cathode, there is a problem of the degradation of lifespan characteristics due to the generation of the Joule heat.

As is apparent from the reaction schemes (2) and (3) above, byproducts such as MgO and $Ba_2SiO_4$ as well as free barium are produced. Those byproducts accumulate to form an intermediate layer between the electron emissive material layer and the metal substrate. The intermediate layer acts as a barrier to hinder the diffusion of the reducing agent such as Mg or Si. As a result, generation of free barium that contributes to the emission of electrons becomes difficult, which is another cause of the cathode's lifespan reduction.

To address the problems described above, an approach of providing conductivity by mixing carbonate with grounded conductive materials has been made to suppress the generation of the Joule heat. However, the addition of conductive materials sufficient to provide a desired conductivity lowers electron emission characteristics.

As an example, EP 0685868 discloses a cathode for an electron tube, so-called "hot isostatic press (HIP) cathode". An electron emission material layer of the cathode is manufactured by mixing grounded metal nickel with carbonate and molding with the mixture under high-temperature and high-pressure conditions. Since the electron emission material layer containing a large amount of metal nickel has conductivity, like a metal, during the operation of the cathode, the electron emission material layer has a longer lifespan under a load of high current density. Disadvantageously, the cathode has a high working temperature of 850° C., which is 50° C. or greater higher than conventional oxide cathodes, and is manufactured by the complicated process described above at higher cost.

EP 0560436 B1 discloses the formation of a conductive path following the principle of percolation by the addition of a globular metal of 20–80% by volume to the electron emission material layer of a conventional oxide cathode to improve the lifespan characteristics of the cathode oxide. For a desired percolation effect, at least 30% by weight globular metal needs to be, incorporated into the electron emission metal layer, which reduces a relative amount of the electron emission material in the layer, thereby lowering the initial emission characteristics of the cathode.

S. N. B. Hodgson et al. discloses an oxide cathode with a percolation path formed by the addition of needle-shaped nickel particles of 2.5–5% by volume to the electron emission material layer in an article entitled "Progress on the Percolation Cathode" (IDW '99 Proceedings of the Sixth International Display Workshops CRT 6-4 (Late-News Paper)). The electron emission material layer of the oxide cathode is formed by a general spraying method, so there is a problem of clogging of spray gun nozzles by metal particles and a great surface roughness of the cathode.

Spraying methods of coating a suspension of carbonate particles by spraying through a spray gun are relatively easily applied to the manufacture of the cathode but are limited in forming a uniform, dense, coated layer because air pressure is the only force applied to coat the layer. In particular, the structure of an electron emission material layer coated by the spraying method is shown in FIGS. 2 and 3. FIG. 2 is a 400×-magnified electromicroscopic photograph of the electron emission material layer coated by the spraying method, where non-uniform particle-to-particle voids, a great surface roughness, and a sparse structure are apparent. FIG. 3 is a 3000×-magnified photograph of the surface of the electron emission material layer of FIG. 2, which confirms non-uniform particle and pore sizes in the electron emission material layer.

As described above, the surface of the carbonate coated by the spray method is uneven, has the non-uniform K-phase distribution, and increases the consumption of the carbonate. Also, the carbonate layer has poor COEK characteristics with a deviation in thickness of ±10 μm (microns). These results cause a Moire phenomenon and thus degrade picture quality.

The Moire phenomenon is defined as non-uniform luminance distribution due to a localized difference in electron emission quantity reaching the surface of a Braun tube due to nonuniform electron emissions during the cathode operation, which occurs when the cathode surface is rough, thus resulting an interference pattern between electron beams and screen dots. The Moire phenomenon is known to be more serious with increasing cathode surface roughness.

To prevent this Moire phenomenon, a method of manufacturing a cathode by screen printing has been suggested. The screen printing method makes the cathode surface uniform, and the quality degradation due to the Moire phenomenon is improved. However, an increase in the density of the carbonate layer causes sintering of the cathode to occur and adversely affects on the cathode lifespan.

In particular, when a cathode ray tube (CRT) is operated for a longer period of time, sintering of the cathode occurs. If the cathode has a non-uniform structure, initially formed pores rupture and shrink to increase the distance between the cathode and a G1 electrode. As a result, a potential difference between the cathode and G1 electrode, which is predetermined for the control of emission electron beams, changes, and a reduction in the quality of charge emission degrades the lifespan and luminance of the cathode.

If a cathode with the electron emission material layer having a non-uniform particle size, pore size, and surface smoothness, as described above, is inserted into an electron gun, product quality and reliability degradation may result. The cathodes described in the references described above still have that problem.

Recently, the tendency for a Braun tube for television receivers or monitors to have high luminance to meet high-definition and large-sized screen requirement has increased a need for a high-current density, long-lifespan cathode, which could not be realized with conventional oxide cathodes having the problems described above.

An impregnated cathode has been known to have long lifespan under a load of high current density. However, it is manufactured by complicated processes and has a working temperature of 1000° C., which is higher than oxide cathodes, so there is a need to form electrode parts of the electron gun using high-melting point materials. This increases the manufacturing cost and thus is impractical. In a practical aspect, it is most economical to improve existing cheap oxide electrodes to have a high current density and extended lifespan.

SUMMARY OF THE INVENTION

To solve the above-described and other problems, it is an object of the present invention to reduce surface roughness of a carbonate layer coated on a cathode to eliminate a Moire phenomenon of a Braun tube and lower resistance to prevent degradation of the cathode caused by Joule heat.

It is another object to have a cathode that is free from degradation of electron emission and lifespan characteristics, which would occur in conventional oxide cathodes when the carbonate layer is coated by a general screen printing method.

It is yet another object to have a cathode where a reduction in the amount of a charge emission due to sintering occurring during the operation of the cathode and the degradation of lifespan and luminance characteristics resulting from the reduced charge emission can be prevented.

It is still another object to have an oxide cathode that has better electron emission and lifespan characteristics than existing carbonate cathodes.

To achieve the above and other objects of the present invention, there is provided an oxide cathode for an electron tube, the oxide cathode including a sleeve for a heater, a metal substrate formed on the top of the sleeve, and an electron emission material layer coated on the metal substrate, wherein the electron emission material layer has a density of 0.7–1.7 g/cm$^3$ (grams per centimeters cubed). The electron emission material layer preferably has a density of 0.8–1.4 g/cm$^3$, and more preferably 1.1 g/cm$^3$.

It is preferable that the electron emission material layer has a surface roughness of 8 μm (micrometers or microns) or less when measured as the distance from a maximum height point to a minimum height point. The electron emission material layer preferably has a thickness of 50–150 μm, more preferably 30–100 μm, and most preferably 70–80 μm.

To achieve the object of the present invention, there is also provided a carbonate paste composition for use in manufacturing an oxide cathode, including an alkaline earth metal carbonate, an organic blowing agent which is thermally decomposable to generate gas, and a vehicle.

Preferably, the organic blowing agent is at least one selected from the group including azodicarbonamide (ADCA), p-toluenesulfonyl hydrazide, p-toluenesulfonylacetone hydrazone, p,p'-oxybis(benzenesulfonyl hydrazide), p-toluenesulfonyl semicarbazide, and N,N'-dinitrosopentamethylene tetramine. More preferably, the organic blowing agent is azodicarbonamide.

Preferably, the vehicle is at least one selected from the group including butyl carbitol, butyl carbitol acetate, terpinol, and ethyl cellulose.

Preferably, the alkaline earth metal carbonate is contained in an amount of 30–60% by weight, the organic blowing agent is contained in an amount of 3–30% by weight, and the vehicle is contained in an amount of 5–67% by weight based on the total weight of the carbonate paste composition.

Preferably, the carbonate paste composition further includes a needle-shaped conductive material. Preferably, the needle-shaped conductive material is at least one selected from the group including carbon, indium tin oxides, nickel, magnesium, rhenium, molybdenum, and platinum. Alternatively, the needle-shaped conductive material may be at least one selected from the group including carbon nanotubes, carbon fibers, and graphite fibers. Alternatively, the needle-shaped conductive material maybe needle-shaped nickel powder or carbon fibers coated with needle-shaped nickel powder.

In the carbonate paste composition according to the present invention, preferably, the alkaline earth metal carbonate is contained in an amount of 30–60% by weight, the organic blowing agent is contained in an amount of 3–30% by weight, the needle-shaped conductive material is contained in an amount of 3–15% by weight, and the vehicle is contained in an amount of 0.1–64% by weight based on the total weight of the carbonate paste composition.

Preferably, the alkaline earth metal carbonate includes $BaCO_3$ of 45–70 parts by weight, $SrCO_3$ of 25–50 parts by weight, and $CaCO_3$ of 1–10 parts by weight.

The object of the present invention is also achieved by a method for manufacturing an oxide cathode for an electron tube which includes a sleeve for a heater, a metal substrate formed on the top of the sleeve, and an electron emission material layer coated on the metal substrate, the method including forming the electron emission material layer by coating the carbonate paste composition described above on the metal substrate by screen printing and thermally treating the coated carbonate paste. It is preferable that the thermal treatment is performed at a temperature of 100–300° C. (Celsius).

The cathode according to the present invention is free from degradation of electron emission and lifespan characteristics, which would occur in conventional oxide cathodes when the carbonate layer is coated by a general screen printing method.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 10:
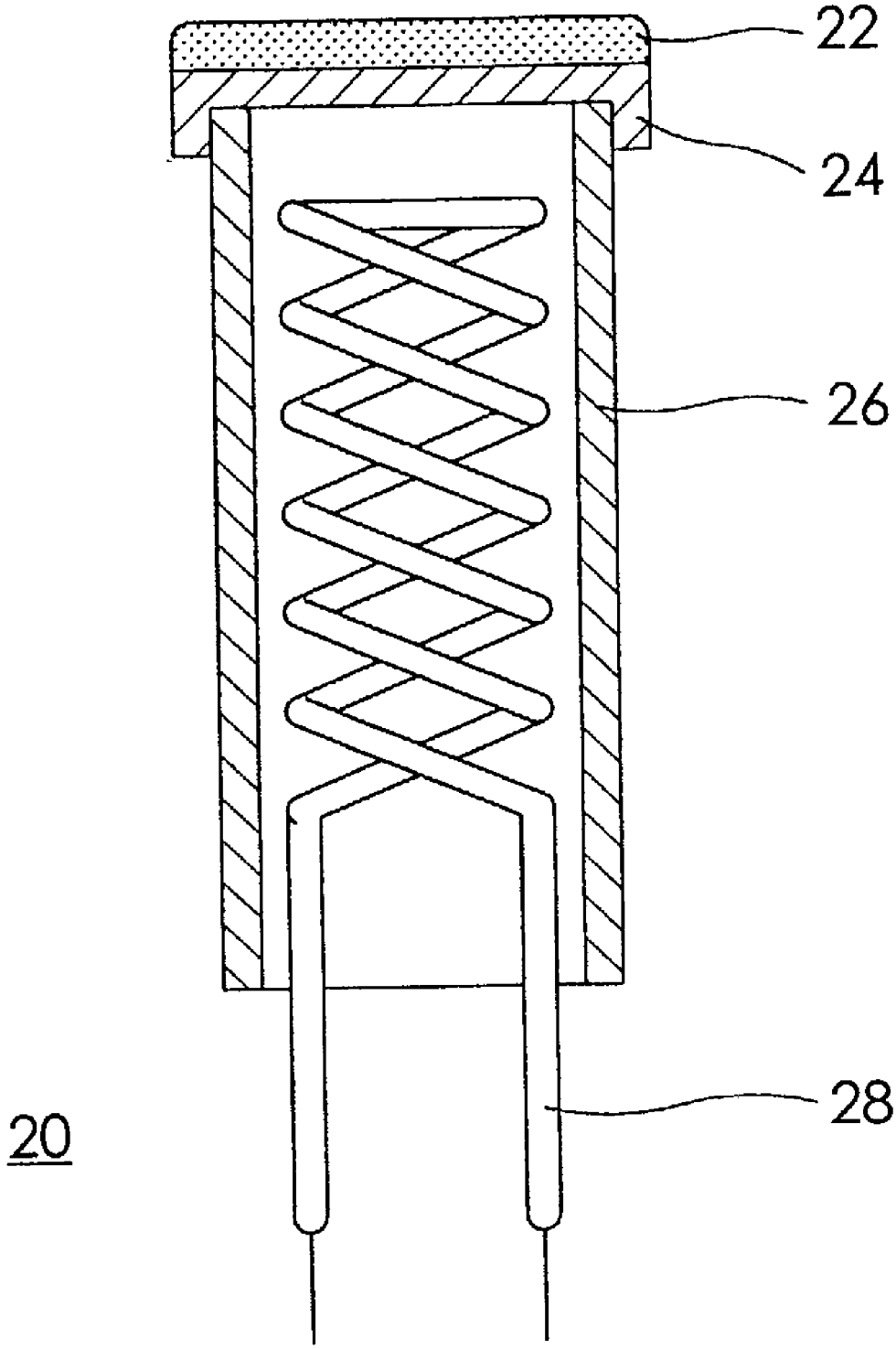
FIG. 10 is a view showing the structure of a cathode of the present invention for an electron tube.

Turning now to the drawings, referring to FIG. 10, a cathode 20 of the present invention includes a disc-type metal substrate 24, a cylindrical sleeve 26 which supports the metal substrate 24 below the same and installs a heater 28 acting as a heater of the cathode 20, and an electron emissive material layer 22 attached to the top of the metal substrate 24.

One of the primary objectives of the present invention is to reduce degradation of an electron emission material layer by its own Joule heat which is considered to be the main cause of the degradation of lifespan characteristics of conventional oxide cathodes under a load of high current density and is to prevent a Moire phenomenon which causes luminance degradation.

A feature of an oxide cathode according to the present invention lies in that the Moire phenomenon of a Braun tube is eliminated by depositing a carbonate paste on a metal substrate by screen printing to relieve the surface roughness of the carbonate layer, and the density of the carbonate layer is lowered to prevent sintering, which usually occurs in a high-density carbonate layer formed by general screen printing methods. Furthermore, the present invention is characterized in that the resistance of the cathode is lowered to reduce the Joule heat with the addition of a needle-shaped conductive material to the carbonate paste.

In the oxide cathode according to the present invention having the features described above, preferably, a density of an electron emission material layer is controlled to be in the range of from 0.7 to 1.7 g/cm$^3$. More preferably, a surface roughness of the oxide cathode is controlled to be 8 μm or less when measured as the distance from a maximum height point to a minimum height point.

When a spraying method is applied to form an electron emission material layer, the surface roughness of the electron emission material layer becomes about 20 μm due to aggregation of particles. In contrast, an oxide cathode formed by screen printing according to the present invention has a smooth surface having a surface roughness of 5 μm or less. When such a screen printing method is applied to reduce the surface roughness of the carbonate layer, picture quality degradation due to the Moire phenomenon is suppressed, whereas the increased density of the carbonate layer causes sintering, thereby adversely affecting the lifespan characteristics of the cathode. In the present invention, the density of the carbonate layer is lowered by adjusting the composition of a carbonate paste to be described later, thereby solving those problems.

In particular, according to the present invention, the carbonate paste to be applied to a metal substrate by screen printing includes an alkaline earth metal carbonate, an organic material, and a vehicle. Here, the alkaline earth metal carbonate provides an electron emission function, and the organic material, preferably, an organic blowing agent, is liable to thermally decompose to lower the density of the carbonate layer and thus prevent sintering during the cathode operation. The vehicle provides the carbonate paste with sufficient viscosity for the screen printing method to be applicable.

Preferably, the carbonate paste according to the present invention further includes a needle-shaped conductive material. The needle-shaped conductive material provides conductivity to the carbonate layer to provide a conduction path of an electron transmission material layer, thereby preventing degradation due to the generation of the Joule heat during the operation of the cathode.

In particular, conductive particles, mostly needle-shaped nickel (Ni) powder or Ni-coated carbon fibers, are added to the carbonate paste to improve the properties of the carbonate paste. General globular powder is distributed in a dispersion medium, as shown in (a) of FIG. 4. It cannot greatly contribute to increasing the conductivity of the carbonate when added in a small amount. If excess globular powder is added, the conductivity increases, whereas a relative amount of the carbonate acting as an electron emitter decreases, thereby degrading the electron emission properties.

Figure 1:
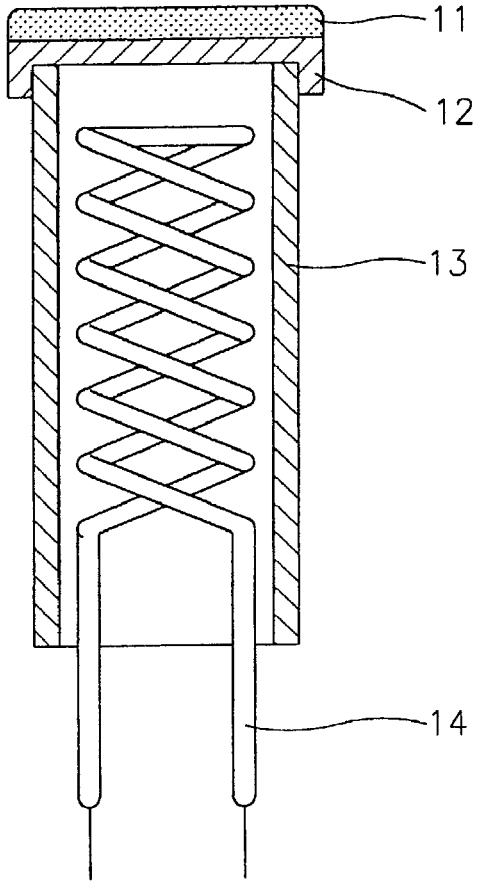
FIG. 1 is a view showing the structure of an existing cathode for an electron tube.
Figure 2:
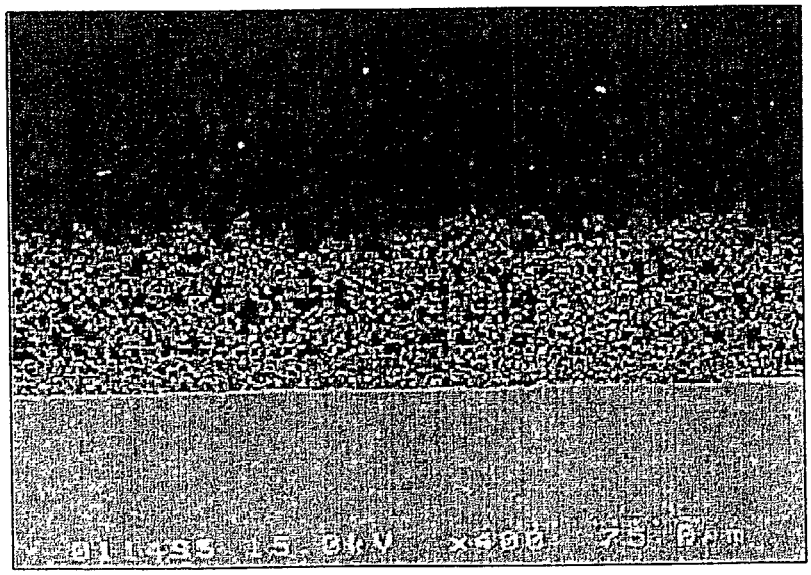
FIG. 2 is a 400×-magnified electromicroscopic photograph of across-section of an electron emission material layer of a conventional cathode.
Figure 3:
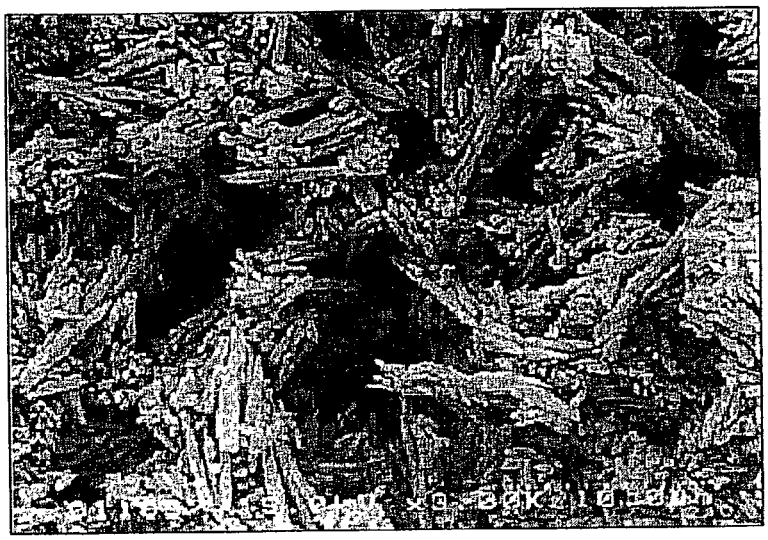
FIG. 3 is a 3000×-magnified photograph of the surface of the electron emission material layer of the cathode of FIG. 2.
Figure 4:
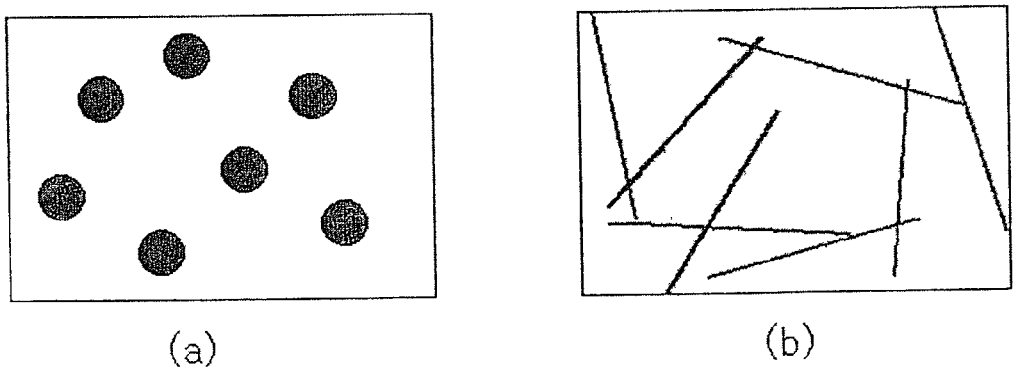
FIG. 4 is an illustration of the shapes of conductive particles incorporated into a carbonate paste according to the present invention.

In contrast, needle-shaped Ni powder forms a network structure in the carbonate medium even in a relatively small amount, as shown in (b) of FIG. 4, thereby improving conductivity. Ni-coated carbon fibers also provide a similar effect. Therefore, it is more effective to add needle-shaped Ni powder, rather than globular Ni powder.

As described above, degradation of lifespan characteristics of an oxide cathode is known to occur as electron emission decreases due to the generation of a high-resistive intermediate product in the electron emission material layer over time. According to the present invention, Ni powder provides an electron emission path in the carbonate layer to extend the lifespan of the cathode.

A carbonate layer formed by coating the carbonate paste containing needle-shaped conductive particles by screen printing has an even surface to relieve the Moire phenomenon and simultaneously provide better electron emission and lifespan characteristics than general oxide cathodes.

A method for manufacturing an oxide cathode according to the present invention will be described below.

Preparation of Carbonate Paste

To manufacture an oxide cathode according to the present invention, a carbonate paste is prepared by mixing alkaline earth metal carbonate powder, an organic material, and a vehicle, preferably, together with needle-shaped conductive powder.

Any carbonate available to manufacture oxide cathodes can be used without limitations, preferably having a basic composition of $(Ba,Sr,Ca)CO_3$ or $(Ba,Sr)CO_3$. Preferably, an amount of the alkaline earth metal carbonate is in the range of from 30 to 60% by weight based on the total weight of the carbonate paste. If an amount of the alkaline earth metal carbonate is less than 30% by weight, electron emission is not sufficient for use in cathode for electron tube. If an amount of the alkaline earth metal carbonate is 60% by weight or more, the fluidity of the paste mixture decreases so that it is difficult to evenly coat the carbonate paste.

Preferably, the composition of the alkaline earth metal carbonate contains $BaCO_3$ of 45–70 parts by weight (45–70% based on the total weight of the alkaline earth metal carbonate), $SrCO_3$ of 25–50 parts by weight (25–50% based on the total weight of the alkaline earth metal carbonate), and $CaCO_3$ of 1–10 parts by weight (1–10% based on the total weight of the alkaline earth metal carbonate). With such a composition, the cathode exhibits optimal electron emission characteristics.

Preferably, the organic material is an organic blowing agent. Suitable organic materials include azodicarbonamide (ADCA), p-toluenesulfonyl hydrazide, p-toluenesulfonylacetone hydrazone, p,p'-oxybis(benzenesulfonyl hydrazide), p-toluenesulfonyl semicarbazide, and N,N'-dinitrosopentamethylene tetrammine, with ADCA being more preferred. Preferably, an amount of the organic blowing agent is in the range of from 3 to 30% by weight based on the total weight of the carbonate paste. If an amount of the organic blowing agent added is less than 3% by weight, the effect of density reduction is low. Even if an amount of the organic blowing agent added is greater than 30% by weight, there is no further density reduction effect.

Suitable vehicles include butyl carbitol, butyl carbitol acetate, terpinol, ethyl cellulose, and the like. An amount of the vehicle added is not limited as long as it can provide viscosity to enable screen-printing.

Preferably, an amount of the needle-shaped conductive powder, which may be additionally added to the carbonate paste, is in the range of from 3 to 15% by weight. If an amount of the needle-shaped conductive powder is less than 3% or less by weight, the resulting electron emission material layer has an insufficient electrical conductivity and is expected not to reduce the generation of the Joule heat by the resistance of the layer. If an amount of the needle-shaped conductive powder is greater than 15% by weight, an amount of the electron emission material such as barium or barium compounds relatively decreases, thereby adversely affecting the electron emission characteristics.

Suitable needled-shaped conductive powder for use in an oxide cathode according to the present invention includes carbonaceous materials such as carbon nanotubes, carbon fibers, and graphite fibers, needled-shaped indium tin oxides, and needle-shaped metal metals such as nickel, magnesium, rhenium, molybdenum, and platinum. Any conductive materials having a resistivity of $10^{-1}$ Ωcm (ohm-centimeter) or less maybe used in the present invention as long as they have a needle shape.

In an embodiment of the preset invention, needle-shaped nickel powder or nickel-coated carbon fibers are more preferred. Carbonaceous materials are more preferred due to their structural stability at high temperature and large aspect ratio.

Longer needle-shaped powder particles enable more effective formation of a conduction channel. Therefore, it is preferable that the needle-shaped powder particles are longer. A preferable range for the aspect ratio (width to length) of the needle-shaped powder particle is from 1:2 to $1:10^4$. If the needle-shaped powder particles are long, sufficient conductivity can be obtained by using only a trace of the needle-shaped powder.

Manufacture of Cathode

The carbonate paste prepared as described above is applied to the top surface of a metal substrate by screen printing and subjected to thermal treatment. The present invention uses a screen printing technique to coat a uniform layer. As a result, oxide particles are evenly distributed in the electron emission material layer without aggregation, with a uniform pore size of 10 μm.

In screen printing, through a mesh screen formed by stretching a net of silk, nylon, TEFLON, stainless steel over a frame and having an ink passing portion and a non-ink passing portion, ink is squeezed using a squeegee out of the mesh screen applied to a substrate on which an image is to be printed, to print the image on the substrate. Since the screen applied for screen printing is flexible, a printing pressure is applied with regard to the flexible screen, and the resulting ink coating is relatively thick, the screen printing technique advantageously does not limit the material of the substrate and even can be applied to a curved substrate. The screen printing technique can be applied with paper, plastic sheets, and printed circuit boards (PCBs) in a variety of fields including the printing industry. In an embodiment of the present invention, the carbonate paste prepared using the materials listed above, instead of ink, was coated using a screen printing machine operating according to the above principles.

It is preferable that a carbonate layer is coated to a thickness of 50–150 μm, in terms of stable electron emission characteristics resistant to the manufacturing conditions for a Braun tube. If the carbonate layer has a thickness less than 50 μm, the electron emission material is absolutely insufficient, so that the lifespan decreases. If the carbonate layer has a thickness greater than 150 μm, the carbonate layer is separated from the substrate. The carbonate layer has a thickness of, more preferably 30–100 μm, and most preferably 70–80 μm.

After the screen printing, the substrate with the carbonate layer is thermally treated at, preferably 100–300° C. (Celsius). Preferably, the thermal treatment involves a pre-drying process at a temperature of 100–150° C. and a drying process at a temperature of 200–300° C. In such a thermal treatment, in particular, during the drying process, the organic blowing agent decomposes, and the vehicle evaporates, thereby leaving only the carbonate on the metal substrate. As a result, a low-density, even carbonate layer is formed. Here, the low-density of the carbonate layer is caused from pores (mostly from $N_2$ gas) generated as the organic blowing agent, typically, ADCA, decomposes.

In the cathode manufactured through the processes described above, the density of the electron emission material layer may be adjusted to be in the range of from 0.7 to 1.7 g/cm$^3$ (grams per centimeters cubed). If the electron emission material layer has a density less than 0.7 g/cm$^3$, the lifespan is shortened due to the insufficient electron emission material. If the electron emission material layer has a density greater than 1.7 g/cm$^3$, the cathode is sintered, thereby adversely affecting the lifespan. The most preferred density of the electron emission material layer is 1.1 g/cm$^3$.

For a density measurement, the carbonate paste was coated on a glass plate three times to size of 2×2 cm$^2$ each and dried at 100° C. After measurement of the thickness of the carbonate layer, the carbonate layer was dried at 250° C. Next, the thickness and weight of the carbonate layer were measured to calculate the density. For accuracy in the thickness measurement, the thickness was measured at 9 positions for each sample to obtain an average density.

The carbonate layer having such an appropriate average density has an even surface and reduces the Moire phenomenon. In addition, the carbonate layer has better electron emission and lifespan characteristics than general carbonate cathodes.

After the oxide cathode formed as described above is assembled into an electron gun, through screen-to-funnel sealing following gun insertion into the funnel, evacuation, and activation processes, an electron tube is manufactured.

The high-performance oxide cathode according to the present invention manufactured by screen printing provides the following effects, compared to conventional cathodes manufactured by a spraying method. As the surface of the carbonate layer becomes even, K phase becomes uniform. The consumption of the carbonate is lower than in the spraying methods. A reduced deviation in the thickness of the carbonate layer improves the COEK characteristics. In addition, the conductivity of the carbonate layer is improved to suppress the generation of the Joule heat during the operation, thereby preventing degradation of the cathodes.

The effects of the present invention on the overall characteristics of an oxide cathode for an electron tube will be described with reference to the following examples. The following examples are for illustrative purposes and are not intended to limit the scope of the invention.

EXAMPLE 1

50 g of a ternary carbonate containing Ba:Sr:Ca in a weight ratio of 57:39:4, 10 g of azodicarbonamide (ADCA), and 40 g of a vehicle containing butyl carbitol (BC) and ethyl cellulose (EC) in a weight ratio of 97:3 were thoroughly mixed in a mixer for 2 hours to prepare a carbonate paste.

The carbonate paste was coated on a metal substrate to a thickness of 80 μm using a screen printer (available from NEW LONG Co.). Here, the distance between a mesh screen of the screen printer and the metal substrate was approximately 2 mm.

The coated carbonate layer was thermally treated at 100° C. for 10 minutes to evaporate the BC and then at 250° C. for 5 minutes to completely decompose the ADCA, thereby resulting in an oxide cathode.

EXAMPLE 2

50 g of a ternary carbonate containing Ba:Sr:Ca in a weight ratio of 57:39:4, 10 g of azodicarbonamide (ADCA), 40 g of a vehicle containing butyl carbitol (BC) and ethyl cellulose (EC) in a weight ratio of 97:3, and 10 g of needle-shaped nickel (Ni) powder were thoroughly mixed in a mixer for 2 hours to prepare a carbonate paste.

The following processes were performed in the same manner as in Example 1 to form an oxide cathode.

COMPARATIVE EXAMPLE 1

An oxide cathode was manufactured in the same manner as in Example 1, except that ADCA was not incorporated into the carbonate paste.

COMPARATIVE EXAMPLE 2

The carbonate paste was subjected to rolling for more than 7 hours to improve particle's dispersion in the carbonate paste. The carbonate paste was set into a spray tank and a spray pressure was adjusted to approximately 4.5 kg/cm$^2$. After spray-coating of the carbonate paste, a rack and an oxide cathode were sequentially disassembled.

The oxide cathodes manufactured in Example 1 and Comparative Example 2 were compared for the density of their electron emission material layer. The results are shown in Table 1.

TABLE 1

| Example | Example 1 (ADCA contained) | Comparative Example 1 (no ADCA contained) |
|---|---|---|
| Density, g/cm$^3$ | 0.939 | 1.909 |

As is apparent from Table 1, the electron emission material layer formed using the carbonate paste containing the organic blowing agent has a lower density than that containing no organic blowing agent.

Figure 6:
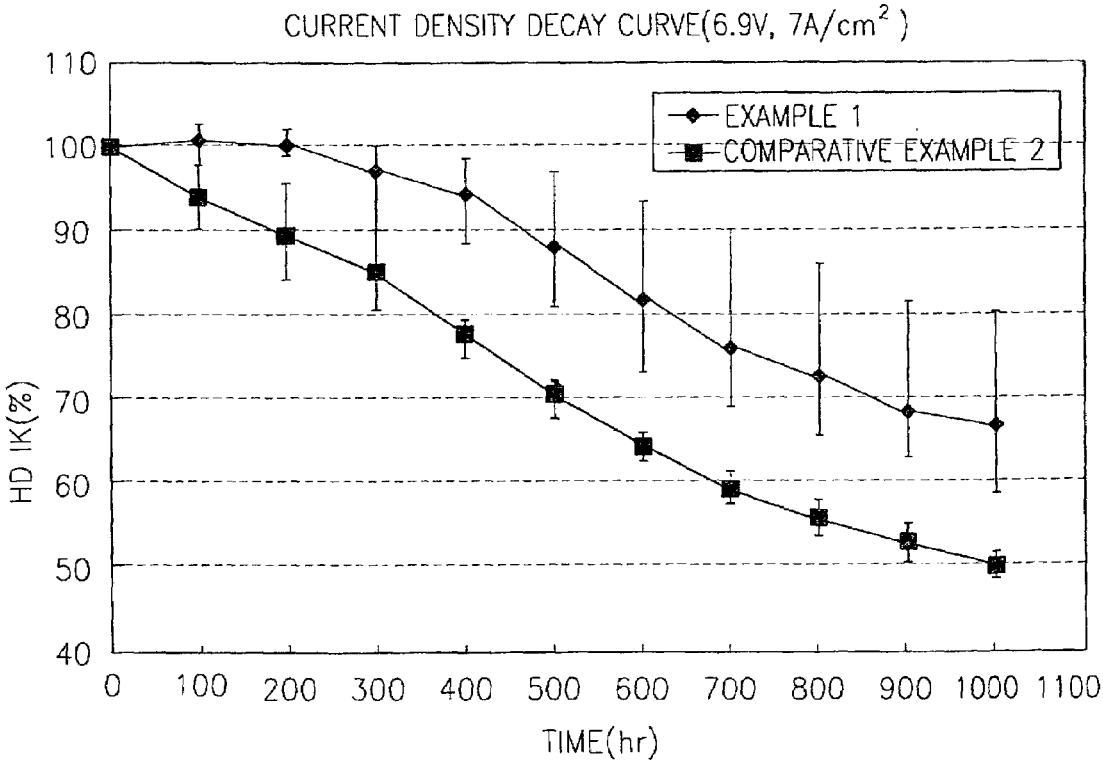
FIGS. 6, 7, and 8 are graphs comparatively showing the lifespan characteristics between the oxide cathode according to the present invention and a conventional oxide cathode.

The result of a comparison between the oxide cathodes of Example 1 and Comparative Example 2 for their current density characteristics is shown in FIG. 6. In FIG. 6, Y-axis denotes the percentage of current density remaining. As shown in FIG. 6, when the screen printing method is applied, the lifespan characteristics of the oxide cathode is improved by 15% or greater, compared to when the spray coating method is applied.

Figure 7:
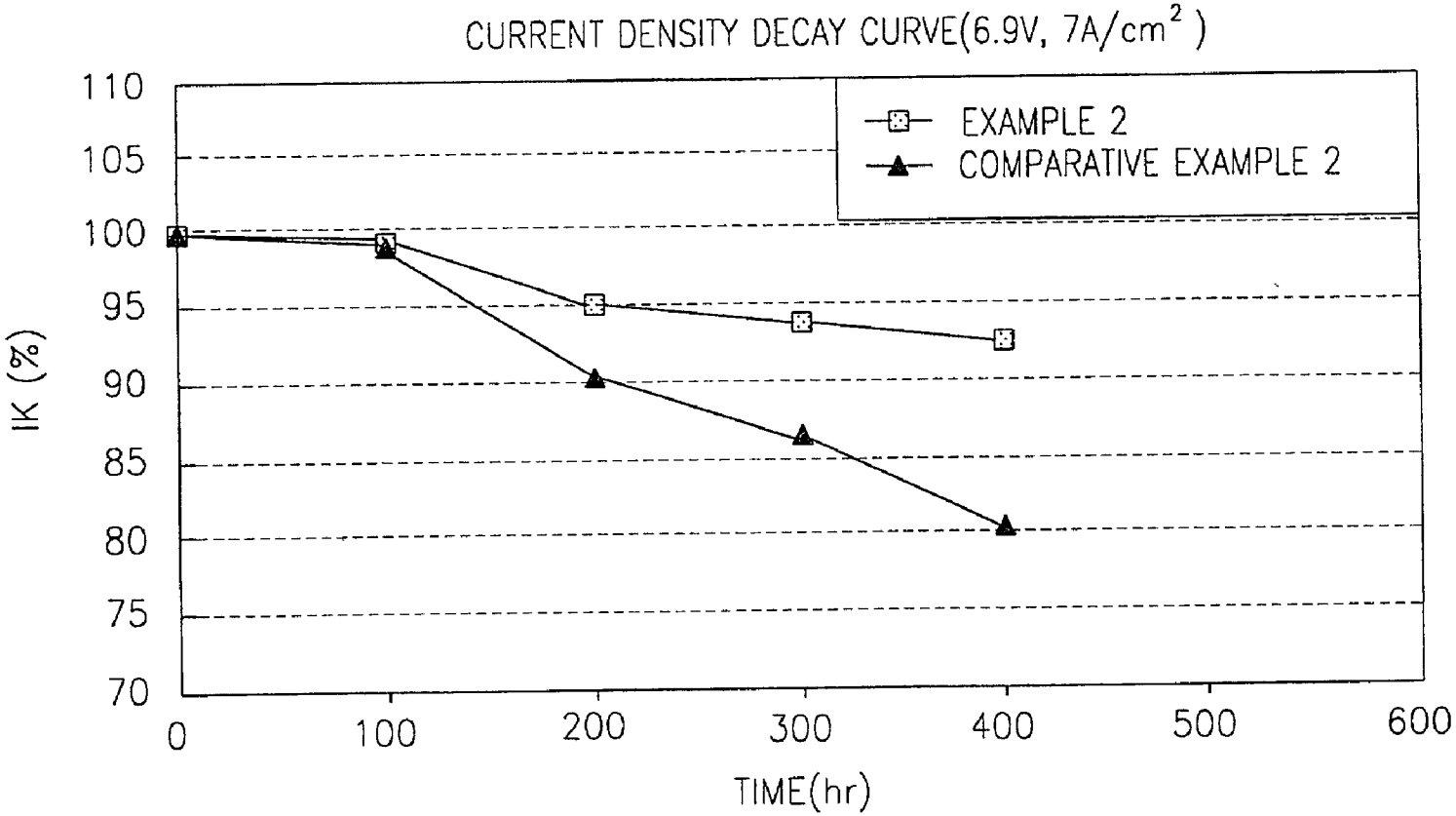

The result of a comparison between the oxide cathodes of Example 2 and Comparative Example 2 for the lifespan characteristics is shown in FIG. 7. In FIG. 7, Y-axis denotes the percentage of current density remaining. As shown in FIG. 7, for the oxide cathode formed using the carbonate paste containing the organic blowing agent by screen printing, the lifespan characteristics are improved by 25% or greater, compared to the oxide cathode formed by the spray coating method.

Figure 8:
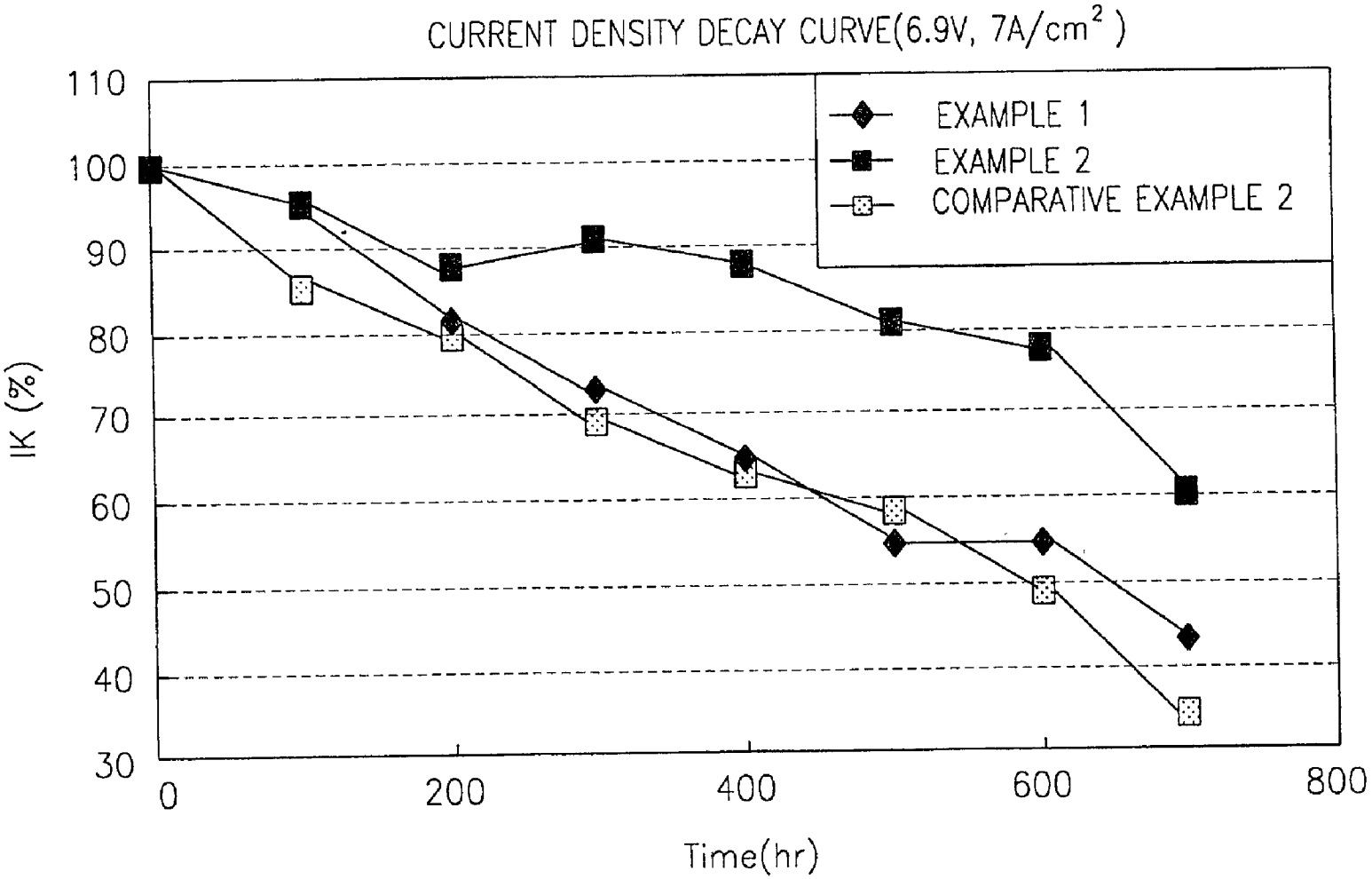

The lifespan characteristics of the oxide cathodes of Example 1, Example 2, and Comparative Example 2 are comparatively shown in FIG. 8. In FIG. 8, Y-axis denotes the percentage of current density remaining. As shown in FIG. 8, the oxide cathode of Example 2 has the best lifespan characteristics.

Figure 5:
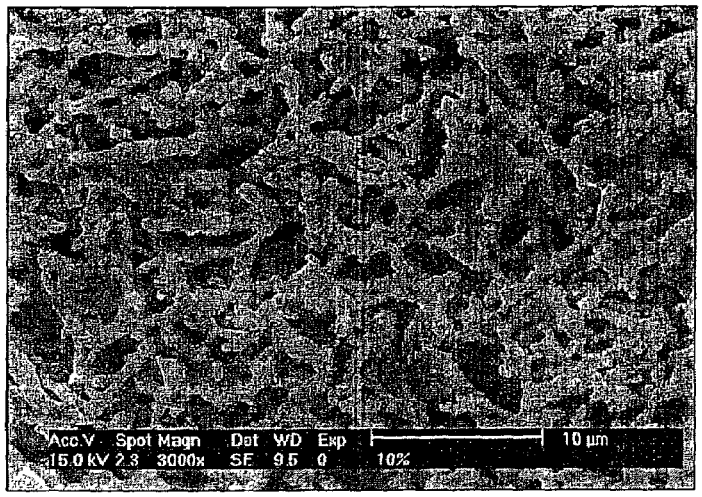
FIG. 5 is a 200×-magnified scanning electron microscopic (SEM) image of the electron emission material layer of an oxide cathode of an embodiment according to the present invention.

A 200×-magnified scanning electron microscopic (SEM) image of the electron emission material layer of the oxide cathode of Example 1 is shown in FIG. 5. As is apparent from FIG. 5, many pores exist in the carbonate layer.

Figure 9A:
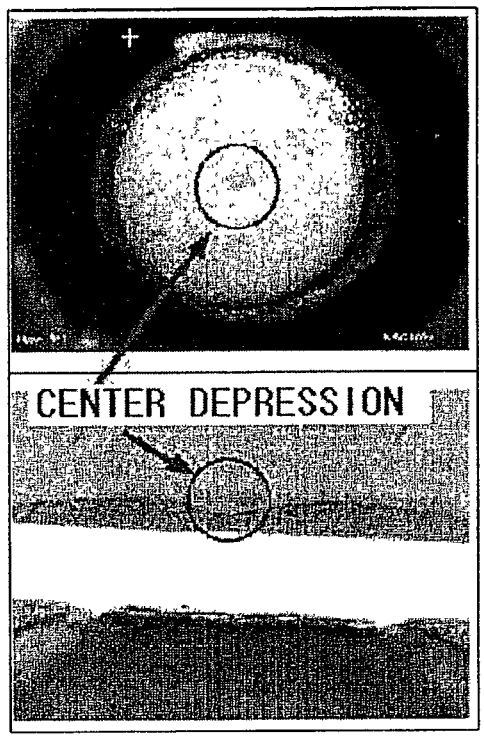
FIG. 9A is a magnified photograph of the surface of a conventional cathode.
Figure 9B:
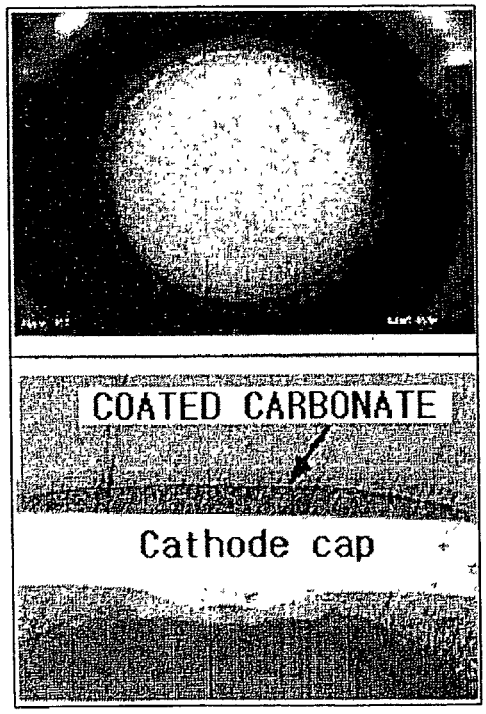
FIG. 9B is a magnified photograph of the surface of the oxide cathode according to the present invention.

FIG. 9A is a magnified photograph of the surface of a conventional cathode, in which a depressed surface center is apparent. FIG. 9B is a magnified photograph of the surface of the oxide cathode according to the present invention, in which an improvement of the central depression is apparent. The oxide cathode according to the present invention exhibits improved coating properties.

As described above, the electron emission material layer of an oxide cathode according to the present invention has an appropriate density. Thus, a reduction in the amount of a charge emission due to sintering occurring during the operation of the cathode and the degradation of lifespan and luminance characteristics resulting from the reduced charge emission can be prevented.

According to the present invention, picture quality degradation due to a Moire phenomenon is reduced by coating carbonate by screen printing to provide an even cathode surface. Also, degradation of the cathode by Joule heat is reduced. Therefore, the oxide cathode according to the present invention has better electron emission and lifespan characteristics than existing carbonate cathodes.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. An oxide cathode for an electron tube, the oxide cathode comprising:

a sleeve for a heater;

a metal substrate formed on the top of said sleeve; and an electron emission material layer coated on said metal substrate, said electron emission material layer having a density of 1.1 to 1.7 g/cm$^3$, the electron emission material layer formed by coating a carbonate paste composition comprising:

an alkaline earth metal carbonate, an organic blowing agent being thermally decomposable to generate gas, and a vehicle, on the metal substrate by screen printing and thermally treating the coated carbonate paste, with said electron emission material layer further comprising a needle-shaped conductive material, with said alkaline earth metal carbonate being contained in an amount of 30–60% by weight, and said needle-shaped conductive material being contained in an amount of 3–15% by weight based on the total weight of said carbonate paste composition of said electron emission material layer.

2. An oxide cathode for an electron tube, the oxide cathode comprising:

a sleeve for a heater;

a metal substrate formed on the top of said sleeve; and an electron emission material layer coated on said metal substrate, said electron emission material layer having a density of 1.1 to 1.7 g/cm$^3$, the electron emission material layer formed by coating a carbonate paste composition comprising;

an alkaline earth metal carbonate, an organic blowing agent being thermally decomposable to generate gas, and a vehicle, on the metal substrate by screen printing and thermally treating the coated carbonate paste, with said electron emission material layer further comprising a needle-shaped conductive material, with said alkaline earth metal carbonate comprising $BaCO_3$ of 45–70 parts by weight, $SrCO_3$ of 25–50 parts by weight, and $CaCO_3$ of 1–10 parts by weight.

3. An oxide cathode for an electron tube, the oxide cathode comprising:

a sleeve for a heater;

a metal substrate formed on the top of said sleeve; and an electron emission material layer coated on said metal substrate, said electron emission material layer having a density of 1.1–1.4 g/cm$^3$.

4. An oxide cathode for an electron tube, the oxide cathode comprising:

a sleeve for a heater;

a metal substrate formed on the too of said sleeve; and an electron emission material layer coated on said metal substrate, said electron emission material layer having a density of 1.1 g/cm$^3$.

5. An oxide cathode for an electron tube, the oxide cathode comprising:

a sleeve for a heater;

a metal substrate formed on the top of said sleeve; and an electron emission material layer coated on said metal substrate, said electron emission material layer having a density of greater than 0.9 g/cm$^3$ and less than or equal to 1.7 g/cm$^3$, with said electron emission material layer including oxide particles evenly distributed in said electron emission material layer without aggregation, with a uniform pore size of 10 μm.

6. An oxide cathode for an electron tube, the oxide cathode comprising:

a sleeve for a heater;

a metal substrate formed on the top of said sleeve; and an electron emission material layer coated on said metal substrate, said electron emission material layer having a density of greater than 0.9 g/cm$^3$ and less than or equal to 1.7 g/cm$^3$, with said electron emission material layer further comprising a needle-shaped conductive material, a range for the aspect ratio, width to length, of said needle-shaped powder particle being from 1:2 to 1:10$^4$.

7. The oxide cathode of claim 6, with said needled-shaped conductive having a resistivity of $10^{-1}$ Ωcm (ohm-centimeter) or less.

* * * * *